United States Patent [19]

Schnabel

[11] 4,030,236

[45] June 21, 1977

[54] TOY BUILDING BLOCKS

[76] Inventor: Walter Schnabel, Im Wolfsgalgen 25, 7141 Schwieberdingen, Germany

[22] Filed: Feb. 4, 1976

[21] Appl. No.: 655,230

[30] Foreign Application Priority Data

Feb. 7, 1975 Germany ..... 2505109

[52] U.S. Cl. ..... 46/25; 46/20
[51] Int. Cl.² ..... A63H 33/08
[58] Field of Search ..... 46/20, 23, 25

[56] References Cited

UNITED STATES PATENTS

| | | | |
|---|---|---|---|
| 729,918 | 6/1903 | Braun | 46/25 |
| 2,088,874 | 8/1937 | Schauer | 46/20 |
| 2,687,033 | 8/1954 | Snyder | 46/20 |
| 3,717,948 | 2/1973 | Schnabel | 46/25 |

*Primary Examiner*—Robert Peshock
*Assistant Examiner*—Robert F. Cutting

[57] ABSTRACT

Toy building blocks are formed with a single row of connecting socket and plug elements. At least one of the exterior surfaces of the block is convexedly bowed and provided with a simulated wood grained structure.

9 Claims, 4 Drawing Figures

TOY BUILDING BLOCKS

BACKGROUND OF THE INVENTION

The present invention relates to toy building blocks and in particular to the construction of toy building blocks which are interconnectable with each other in sets to form model constructions in which the blocks are formed with opposite parallel sides, on one of which plugs are formed and on the other of which sockets are formed, in a conforming predetermined spatial relationship.

A variety of building block sets are known which differ from each other in the development and arrangement of their individual connecting elements, only because of the applied system of interconnection. In the conventionally used construction kits, the majority of the blocks are formed with two rows of connecting elements so that a universal arrangement can be built in at least two directions. As a supplement such kits are sometimes provided with other blocks which have only one row of connecting elements.

Notwithstanding such block formations the blocks of commercially available sets produce walls having only flat faces. It is therefore difficult, if not impossible to produce model constructions which simulate wood-like constructions such as log-cabins, block-houses or the like. At best those that attempt such forms, result in a model construction which is very rough and inaccurate in their appearance.

It in an object of the present invention to provide model construction blocks which overcome the disadvantages of the prior art and which provides blocks having a more accurate and truthful wood-like appearance, without giving up the desirable characteristics of known blocks for variety in form and construction.

SUMMARY OF THE INVENTION

In accordance with the present invention toy building blocks are formed in which at least one of the exterior sides of each block is formed with a convex surface on which an imitation wood grain structure is made. The blocks are formed of hollow bodies with the intended abutting surfaces, extending perpendicularly to the convex side. The abutting surfaces are provided with conforming socket and plug interconnections spaced at predetermined units from each other. The convex bowing extends in the direction of interconnection. A wall constructed with such blocks will provide an impression of reality, as when these are arranged in the manner of horizontal logs or timbers.

Similarly, such blocks turned 90° can also be integrated within a model construction. It is further possible, to especially form such blocks to fit in this position. For such vertical blocks it is preferred that the blocks with a length which extends only one basic unit measurement while its height extends a multiple of the height of the other blocks; that the exterior face of the block is convexedly formed transverse to the direction in which the blocks are interconnected. The vertical blocks are also formed as hollow bodies, and have connecting elements on their frontal faces.

When the blocks are formed so as to be arranged in horizontal direction, the depth of the block across the abutting or connecting faces (i.e., the faces on which elements are formed) comprises the basic unit of measurement of the blocks. Structural connections for a variety of model constructions may be easily realized even though the blocks in each set vary, by providing longitudinal blocks having a length as an integral multiple of the basic unit of measurement so that the oppositely situated connecting element at each of the ends of the block are set with their centers at one-half (1/2) of the basic unit from the frontal faces. In such blocks the exterior surface is convexedly formed in the direction by which the blocks are interconnected. A further embodiment permits the formation of realistic corner connections having a strong interconnectability. A unitary right angle member, whose arms are set at an angle of 90° from each other can be provided with a size, connecting elements and convex grained face, as if both arms were longitudinal or horizontally applied blocks.

The blocks of the present invention can be incorporated into a model construction formed with other commercially available block sets so long as the magnitude of the new blocks approximate that of the conventional block which have at least two rows of interconnection. Thus the new blocks permit, without any difficulty the construction of various models by merely interchanging the use of conventional blocks and blocks of the present invention.

It is preferred to form blocks of the present invention from plastic material which may be conventionally molded. Preferably the blocks are formed as hollow bodies open, to the interior, from one of the connecting or abutting faces, and wherein the sockets and plugs are formed of hollow cylinders, extending from the opposite connecting face through the body; the holes forming the sockets opening from the solid face and the plugs extending through the open face. The blocks can thus be constructed with strong walls while being inexpensive and simple.

Full details of the present invention are set forth in the following description and are shown in the accompanying drawing.

BRIEF DESCRIPTION OF THE DRAWINGS

In the accompanying drawings.

DESCRIPTION OF THE INVENTION

Figure 1:
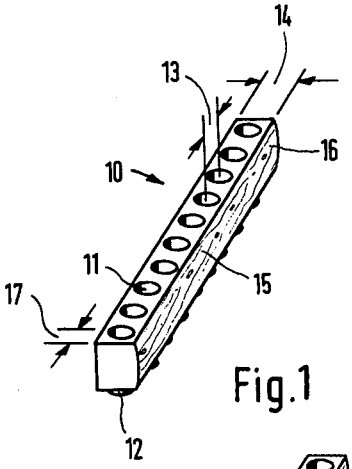
FIG. 1 is a perspective view of a beam or rail used as a horizontal block according to the present invention.

As seen in FIG. 1, the lengthwise block, generally indicated by the numeral 10, carries on its upper surface (forming one connecting or abutting surface) a row of holes 11 which form sockets for the receipt of conforming plugs, on similarly made blocks, or on commercially available blocks, made with conforming plugs. Extending from the lower surface of the block 10 is a conforming row of plugs 12. These holes 11 and plugs 12 are uniformly and equally spaced in predetermined units 13 (measured from their central axes) along the length of the block, with the opposing end ones spaced from the frontal end face of blocks by a distance 17 which is one half of the basic unit. The depth 14 of the block 10 is equal to the basic unit 13, and is, of course, the same in area between the upper and lower sides, so that an approximate rectangle or square can be formed. The length of the block 10 is preferably an integral multiple of the basic unit 13. The exterior side surface of the block 10 is, as indicated by the numeral 15, convexedly bowed transverse to its length, (i.e., in the direction of interconnection) and is formed with a simulated wood grain structure 16.

Figure 2:
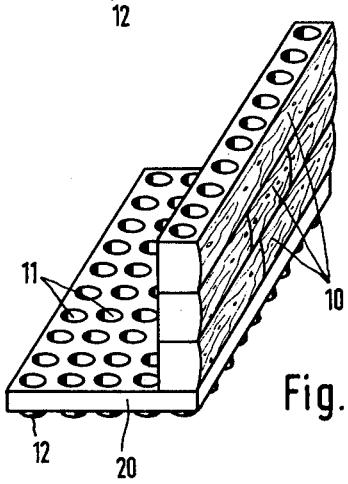
FIG. 2 is a perspective view of a partial assembly of several beams, shown in FIG. 1, with a base plate of conventional construction.

By using varying lengths of the blocks 10, as shown in FIG. 2, a wall can be built, which can even be supported on a commercially available base plate 20. The base plate 20 should be provided with a plurality of rows of holes 11 and plugs 12, which are uniformly spaced in intervals conforming to the basic unit 13.

Figure 3:
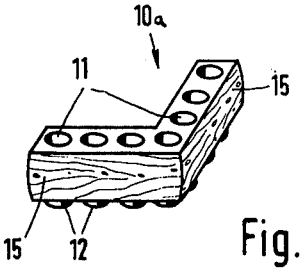
FIG. 3 is a perspective view of a cover member, formed according to the present invention.

It will be easily seen that with the use of blocks 10*a* as shown in FIG. 3, that a corner arrangement can be made. The corner blocks 10*a* have a pair of arms 15, identical with the beams of FIG. 1, integrally or unitarily formed together at an angle of 90° to each other. Each arm is provided with a row of holes 11 and plugs 12 extending uniformly from a common hole and plug set at the corner or apex of the block, so that they extend longitudinally and transverse. The exterior wall of both arms is convexedly bowed and wood grained.

The blocks 10 and 10*a* are formed of hollow bodies which are open from the bottom connecting surface. That is, the surface on which the holes are formed is closed, and the exterior and interior faces depend, as a skirt from them, having the plugs 12 extending freely from the open bottom surface. The holes 11 and plugs 12 are unitarily formed as cylinders joined about their upper edge to the closed wall of the upper surface. The cylinders may be opened or closed at their lower ends forming the plugs. With this construction the blocks 10 and 10*a* permit the construction of strong interconnected wall models. The blocks may be molded (either by die or injection molding) or otherwise formed as unitary members from plastic material of a strong durable but inexpensive material.

Figure 4:
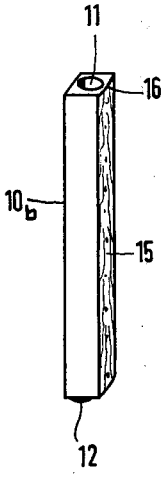
FIG. 4 is a perspective view of a vertical beam or strut formed according to the present invention.

In FIG. 4 a vertical strut type block 10*b* is shown. The height of this block is a multiple of the height of the horizontal blocks 10 and 10*a* while its length and depth are formed equal to the basic unit 13. The frontal end faces carry a single hole 11 and a single plug 12, with the longitudinal faces being smooth. The exterior surface 15 is convexedly formed transverse to its length (i.e., transverse to the direction of interconnection) and is provided with a simulated wood grain finish. The thus vertically oriented block 10*b* is also made of plastic, in a similar manner, but is hollow along its length, by omitting the rear or interior wall.

The blocks of the present invention can be made platelike, that is, in board like form. the convex exterior side can be formed with a structure simulating a wood beam, while the flat rear side can be made with a simulated wood board finish, such as is found in interior of houses. Each plate-like block can be formed with a plurality of bands of several wood beam or board assemblies, that is striated, and extend over one or more coordinated specified connecting element systems. The plate-like blocks can therefore be provided with connecting elements in their under and/or upper surfaces.

In the horizontal block shown in FIG. 1, the rear or interior surface can similarly be provided with a finish simulating a wood board. the block can thus be used to form a construction of log timbers, beams or a construction of boards, independently of each other.

Should the blocks be arranged vertically then constructions are permitted in which a realistic inside and/or outside corner connection can be made between two perpendicularly standing walls. An especially made block having two arms extending right angles may be formed in which either surface forms an exterior wall and in which at least a portion is convexedly bowed and is provided with a simulated timber or log structure. The rest of both exterior walls may be provided with interconnecting elements.

In order to cover a model structure, shaped like a house, it is advantageous to use the plate-like board blocks which are provided on their exterior sides with appropriate roof-life structure and equal blocks having connecting elements on their rear surfaces, which are perpendicularly arranged to the plate-like blocks and in the predetermined spatial arrangement.

Various modifications, changes and embodiments have been shown and others will be obvious to those skilled in the art. Accordingly, the present disclosure is intended to be taken as illustrative of the present invention and not as limiting of its scope.

What we claim is:

1. A toy building block for interengagement with similarly constructed toy building blocks comprising a unitary plastic member having a first planar contact surface with at least one hole formed therein, a second planar contact surface parallel to said first contact surface with at least one plug extending therefrom, said holes and plugs being in alignment transverse to the plane of said contact surfaces, planar end surfaces extending perpendicular between said contact surfaces, at least one side face extending between said first and second contact surfaces and said end surfaces, said contact surfaces, said end surfaces and said one side face being integral joined along their edges to form an elongated closed rectangular block, said one side face being convexedly formed so as to extend outwardly from a plane containing the edges of said side face connected to said first and second connecting surfaces, and having molded integral thereon a simulating wood graining extending over its entire area.

2. The toy block according to claim 1, wherein said toy block has a depth measured perpendicularly from said first side face toward its opposite side, a height measured perpendicularly from said first connecting surface to said second connecting surface and a length measured by the distance between the end surfaces, said first connecting surface having a plurality of equally spaced holes formed therein and said second connecting surface having a plurality of equally spaced plugs extending therefrom, the distance between an end hole and a corresponding end of said first connecting surface as measured along said length being equal to half the distance between the centers of two adjacent holes.

3. The toy block according to claim 2, including a second side surface molded in a simulating wood graining and being convexedly formed.

4. The toy block according to claim 2, wherein said first connecting surface comprises a first leg portion having a plurality of said holes and a second leg portion at right angles to said first leg portion also having a plurality of said holes, said first and second leg portions having one common hole, and said second connecting surface comprises a first leg portion having a plurality of said plugs in alignment with said plurality of holes formed in said first leg portion of said first connecting surface, and a second leg portion at right angles to said first leg portion of said second connecting surface also having a plurality of said plugs in alignment with said plurality of holes formed in said second leg portion of said first connecting surface, said first and second leg portions of said second connecting surface having a common plug.

5. The toy block according to claim 1, wherein said toy block has a depth measured perpendicularly from said first side surface to said second side surface, a height measured perpendicularly from said first connecting surface to said second connecting surface, and a length measured by the length of one of said first and second connecting surfaces, said height having a greater dimension than either of said depth and said length.

6. The toy block according to claim 1, wherein said toy block is hollow, and said at least one plug extends from said at least one hole in a direction parallel with a perpendicular between said first and second connecting surfaces, said second connecting surface being formed by an end surface of said at least one plug.

7. The toy block according to claim 6, wherein said at least one plug comprises a first end surface and a second end surface, said first end surface having said at least one hole formed therein, and said second end surface is spaced from said first end surface beyond the edges of said first and second side surfaces remote from said first connecting surface.

8. The toy block according to claim 7, wherein said first side surface comprises a simulated wood board finish, said first side surface being flat.

9. The toy block according to claim 8, wherein said toy block is formed as a plate where the length is greater than the height and the depth, and wherein the depth is greater than the height, said height being measured perpendicularly from said first connecting surface to said second connecting surface, said depth being measured perpendicularly from said first side surface to said second side surface, and said length being measured by the length of one of said first and second connecting surfaces.

* * * * *